US005119562A

United States Patent [19]

Dietz

[11] Patent Number: 5,119,562

[45] Date of Patent: Jun. 9, 1992

[54] HAND TOOL FOR SPLITTING STRAW INTO STRIPS

[76] Inventor: Rolf A. H. Dietz, Königsberger Str. 45/1, D-6930 Eberbach, Fed. Rep. of Germany

[21] Appl. No.: 635,153

[22] PCT Filed: Apr. 24, 1990

[86] PCT No.: PCT/EP90/00663

§ 371 Date: Dec. 21, 1990

§ 102(e) Date: Dec. 21, 1990

[87] PCT Pub. No.: WO90/12677

PCT Pub. Date: Nov. 1, 1990

[30] Foreign Application Priority Data

Apr. 25, 1989 [DE] Fed. Rep. of Germany ..... 8905177

[51] Int. Cl.[5] ..... B26B 3/00

[52] U.S. Cl. ..... 30/303; 30/299

[58] Field of Search ..... 30/299, 314, 315, 316, 30/301, 303, 302

[56] References Cited

U.S. PATENT DOCUMENTS

| | | | |
|---|---|---|---|
| 992,667 | 5/1911 | Kandlbinder | 30/316 |
| 2,329,918 | 9/1943 | Leavens | 30/303 |
| 2,558,579 | 6/1951 | Polk, Sr. et al. | 30/303 |
| 2,751,864 | 6/1956 | Parker | 30/316 |

FOREIGN PATENT DOCUMENTS

| | | | |
|---|---|---|---|
| 8436292 | 5/1985 | Fed. Rep. of Germany . | |
| 2475805 | 8/1981 | France . | |
| 602414 | 5/1948 | United Kingdom | 30/303 |

*Primary Examiner*—Douglas D. Watts
*Assistant Examiner*—Hwei-Siu Payer
*Attorney, Agent, or Firm*—Peter K. Kontler

[57] ABSTRACT

A hand tool for splitting straw into strips has a pot-shaped element with a bottom and an open side opposite the bottom. A tube is mounted in the bottom coaxially with the pot-shaped element and has an end face which is flush with the outer side of the bottom. The tube, which defines a passage for stalks of straw to be split, extends from the bottom into the pot-shaped element. A rod is disposed internally of the tube coaxially therewith and has a cross-sectional area smaller than the cross-sectional areas of the stalks to be split. A plurality of blades project radially from the rod to the inner wall of the tube and are uniformly distributed circumferentially of the latter. Each of the blades has a cutting edge which faces the bottom of the pot-shaped element. The cutting edges extend along respective generatrices of a cone which converges towards the bottom of the pot-shaped element.

17 Claims, 1 Drawing Sheet

HAND TOOL FOR SPLITTING STRAW INTO STRIPS

BACKGROUND OF THE INVENTION

The invention relates to a hand tool for splitting straw into strips. The hand tool includes a holder having a straight channel with a smooth channel wall, and a plurality of blades uniformly distributed about the periphery and oriented radially to the channel axis. The cutting edges of the blades face the front opening of the channel.

Such hand tools are useful for the production of straw mesh and other wickerwork of straw strips because such straw strips are most easily obtained by splitting straw longitudinally.

In a hand tool of this type disclosed in the German Gebrauchsmuster no. 84 36 292, the blades are normal to the channel radius. A stalk of straw to be split is coaxially placed on the star-like blade array and moved through the channel. Each blade is to generate a split along the stalk so that a strip of straw, which exits or can be drawn out of the rear end of the channel, is obtained between two neighboring blades.

It is desirable to split a stalk of straw into strips whose widths are as equal as possible. In the known tool, the stalk must, to this end, be moved through the channel exactly coaxially.

SUMMARY OF THE INVENTION

It is an object of the invention to design a hand tool of the type mentioned at the outset in such a manner that it is easier to manipulate and more reliable in operation.

The invention is characterized in that the cutting edges extend along the generatrices of a cone of circular cross section and to the channel wall. The cone converges towards the front opening of the channel and is coaxial with the channel axis.

Due to the arrangement of the cutting edges along the generatrices, the cutting edges cooperate to define a tip which faces the front opening of the channel and automatically functions as a centering tip for a deposited stalk of straw to be divided. The inclined disposition of the cutting edges further results in a cut under tension with a substantial improvement in the operational reliability as compared to the conventional hand tool.

If, upon insertion of a stalk of straw, it should happen that one of the contemplated longitudinal cuts is not initiated, the corresponding strip of double width slides along the blade until, at the end of the blade, it contacts the wall bounding the channel. No later than at this location, the straw is unable to resist the cutting action of the cutting edge any longer and is incised due to the thrust exerted from above. Once the delayed incision has been made, the cut, which is essentially a split, propagates, similarly to the other cuts, as the stalk of straw is pushed farther into the channel or the strips issuing from the other end of the channel are withdrawn. This action, also, significantly increases the operational reliability and reduces waste.

The geometric arrangement of the cutting edges—inclined, on the one hand, and to the channel wall, on the other hand—enhances the dividing action of the blades to such a degree that, as found in practice, plastic blades may be substituted for metallic blades. These plastic blades may be easily and economically made in the form of an injection molded plastic part which constitutes the entire hand tool. However, the invention is not limited to the use of plastic blades. The blades can also consist of metal.

The width of the channel is so large that the largest stalks of straw to be processed fit easily.

In order that stalks of straw with small diameter may be processed with the same hand tool, a design in which the cutting edges reach a central rod coaxial with the channel axis is recommended. The cross section of at least the front end of the central rod is smaller than the internal cross section of a stalk of straw to be split and the cross section of the channel is larger than the cross section of a stalk of straw to be split. The central rod is so narrow that at least the front end thereof readily fits in the interior of the narrowest stalk of straw to be processed.

The channel can have a circular cross section. However, to enhance guidance of the strips which are generated, it is recommended that the cross section of the channel be designed as a regular polygon and that a blade be arranged on the radius associated with each corner.

In this connection, the cross-sectional configuration of the channel is preferably a regular hexagon with six associated blades.

For reasons of stability and for enhancement of injection molding, it is recommended, particularly for plastic blades, that the blades be designed so as to progressively increase in thickness from the respective cutting edge towards the channel axis along a direction which is inclined with respect to the rear opening of the channel.

Based on commercial straw, the following dimensions have been found satisfactory: a channel diameter of 8 to 11 mm, preferably 10 mm; a diameter of 0.6 to 1.2 mm, preferably 0.9 mm, for the front end of the central rod and 1.0 to 4.0 mm, preferably 2.3 mm, for the rear end thereof; a width of 0.3 to 1.5 mm, preferably 1.2 mm, for the radially outermost, rear ends of the blades; and, for each strip, a gap between neighboring blades at the rear ends of the blades having a width of at least 2.5 mm to 5.0 mm, preferably 4.0 mm, as measured circumferentially.

A particularly convenient design of the hand tool is achieved by providing a holder in the form of an open pot which is coaxial with the channel axis. A tube defining the channel is inserted in the bottom of the pot so that the front end of the tube is flush with the outer side of the bottom and the remainder of the tube extends essentially within the pot.

The hand tool can be dimensioned such that commercial straw can be processed thereby. However, it is also possible to provide a plurality of differently dimensioned channels in a single hand tool for straw of different thickness or different diameter. This can be accomplished in that a plurality of differently dimensioned tubes and/or a plurality of tubes equipped with different numbers of blades are arranged parallel and next to one another in a single holder with each tube defining a respective channel.

BRIEF DESCRIPTION OF THE DRAWING

The invention will now be described in detail with reference to the accompanying drawing.

In the drawing.

DESCRIPTION OF THE PREFERRED EMBODIMENTS

The right halves which are not illustrated in the Figures are mirror symmetrical to the illustrated left halves.

Figure 1:
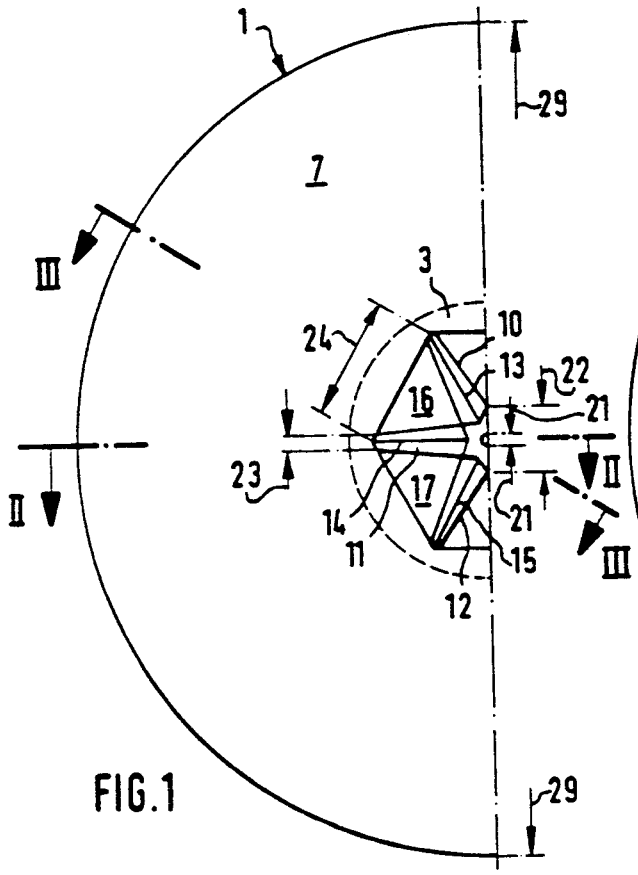
FIG. 1 is a plan view of the left half of a hand tool.
Figure 2:
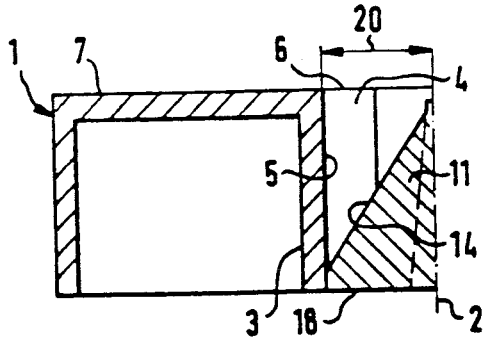
FIG. 2 shows the section II of FIG. 1.
Figure 3:
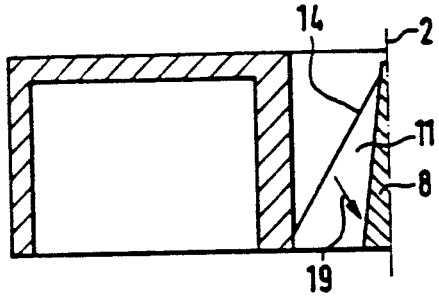
FIG. 3 shows the section III of FIG. 1.

In FIGS. 1 to 3, 1 identifies a circular pot which is coaxial with the axis 2 and, in FIG. 1, faces away from the observer with its open side. A tube 3 defining a straight channel 4 having a smooth channel wall 5 is formed in the bottom of this pot coaxially with the axis 2. The tube 3 is formed in the bottom 7 of the pot such that the front opening 6 of the channel facing the observer of FIG. 1 is flush with the bottom 7 and the remainder of the tube 3 extends essentially completely within the pot 1. The internal cross section of the tube 3 is in the form of a regular hexagon as can be seen particularly clearly in FIG. 1. A central rod 8 extends coaxially inside the tube and flat blades, of which the blades 10,11,12 are visible in FIGS. 1 to 3, project radially therefrom towards the six corners.

The cutting edges 13 to 15, as well as the blade cutting edges which are not visible in FIGS. 1 to 3, face the front opening 6 of the channel and extend along the generatrices of a cone of circular cross section which converges towards the front opening 6 of the channel and is coaxial with the channel axis 2. The blades and the cutting edges reach the channel wall 5 so that the rear end of the channel 4 is divided into six openings, exemplified by the openings 16,17, of triangular cross section.

The blades are thinnest at their cutting edges and progressively increase in thickness from the respective cutting edges towards the channel axis 2 along a direction, indicated by arrow 19, which is inclined with respect to the rear opening 18 of the channel.

The diameter of the channel from edge to edge, which corresponds to twice the radius arrow 20, is 10 mm. The diameter of the front end of the central rod 8, shown by the double arrow 21, is 0.9 mm. The diameter of the rear end of the central rod 8, indicated by the double arrow 22, is 2.2 mm. The width of the blades at their outermost rearward ends, shown by the double arrow 23, is 1.2 mm. The width of each opening 16,17 . . . at the rear end, measured in circumferential direction per the double arrow 24, is 4.0 mm. The diameter of the pot 1, indicated by the double arrow 29, is 49.0 mm.

To cut up a stalk of straw, the latter is inserted in the front opening 6 of the channel coaxially with the axis 2 thereby centering itself on the blades and also being held in this centered position by the blades. As soon as adequate pressure is exerted on the stalk, the blades begin to cut the same into six strips. The six strips individually exit through the six openings 16,17 . . . which together form the rear opening 18 of the channel. When a length of these strips sufficiently large to grip has issued, the strips can be grasped with the hand and pulled out of the channel to thus cut up the rest of the stalk. The dimensions given by way of example make the hand tool suitable for cutting up stalks of straw having commercial sizes.

The hand tool illustrated in FIGS. 1 to 3 is integrally produced from plastic using an injection molding process.

In a modification of the illustrated embodiment, the blades can consist of metal instead of plastic while the remaining parts are made of plastic in which the blades are inserted.

Figure 4:
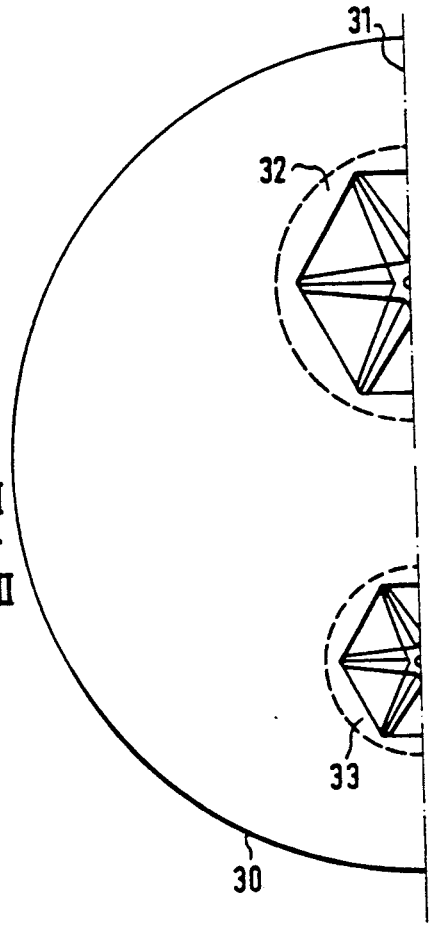
FIG. 4 is a plan view of the left half of another embodiment.

The second embodiment illustrated in FIG. 4 has a pot-shaped holder 30 which is identical to the pot of FIGS. 1 to 3. Two tubes 32,33 corresponding to the tube 3 of FIGS. 1 to 3 are arranged along a center line 31 in this pot-shaped holder. These two tubes are equipped with blades exactly like the tube 3 of FIGS. 1 to 3. The tube 32 and its blades are dimensioned precisely like the tube of FIGS. 1 to 3 while the tube 33 is smaller than the tube 32 with a proportional reduction in size of the blades.

Large blades of straw are cut up in the tube 32 whereas thinner stalks are cut up in the tube 33.

Two or more tubes equipped with blades can also be provided in one and the same holder and can have different dimensions and/or different numbers of blades.

I claim:

1. A hand tool for dividing straw into strips, comprising a holder provided with a plurality of substantially parallel tubular elements each of which defines a passage having an inlet opening for stalks of straw to be divided and an outlet opening for strips of straw; and a plurality of blades in each of said passages, each of said blades having a cutting edge which faces the respective inlet opening, and the cutting edges in each of said passages extending along respective generatrices of a cone which is substantially coaxial with the respective passage and converges towards the respective inlet opening.

2. The tool of claim 1, wherein said holder comprises wall means bounding at least one of said passages and the respective cutting edges extend substantially to said wall means.

3. The tool of claim 1, wherein said holder comprises wall means bounding at least one of said passages and said wall means is substantially smooth, said at least one passage being essentially straight.

4. The tool of claim 1, wherein said blades are substantially uniformly distributed circumferentially, and extend radially, of the respective passages.

5. The tool of claim 1, wherein said holder comprises a rod in at least one of said passages which is substantially coaxial therewith and the respective cutting edges extend substantially from said rod, said rod having a front end with a first cross-sectional area smaller than the internal cross-sectional areas of the stalks, and said at least one passage having a second cross-sectional area greater than the external cross-sectional areas of the stalks.

6. The tool of claim 1, wherein at least one of said passages has an axis and is in the form of a regular polygon having a plurality of corners, at least one blade extending towards each of said corners, and each of said at least one blades being located substantially in a plane which includes said axis and the respective corner.

7. The tool of claim 6, wherein said at least one passage is in the form of a regular hexagon and the number of blades in said at least one passage is six.

8. The tool of claim 1, wherein at least one of said passages has an axis and the thicknesses of the respective blades increase towards the respective outlet opening and said axis.

9. The tool of claim 8, wherein the thicknesses of the blades in said at least one passage increase progressively.

10. The tool of claim 1, wherein said holder comprises a rod in at least one of said passages which is substantially coaxial therewith and the respective cutting edges extend substantially from said rod, said rod having a front end with a diameter of about 0.6 to about 1.2 mm and a rear end with a diameter of about 1.0 to about 4.0 mm, said at least one passage having a diameter of about 8 to about 11 mm, and the respective blades having radially outermost, rearward ends with a width of about 0.3 to about 1.5 mm, the rearward ends of neighboring ones of said blades being spaced from one another by about 2.5 to about 5.0 mm as measured in circumferential direction of said at least one passage.

11. The tool of claim 10, wherein the diameter of said at least one passage is substantially 10 mm, the diameter of said front end is substantially 0.9 mm, the diameter of said rear end is substantially 2.2 mm, the width of said rearward ends is substantially 1.2 mm and the spacing between said rearward ends of neighboring blades is substantially 4.0 mm.

12. The tool of claim 1, wherein said holder comprises a pot-shaped element having a bottom, and said tubular elements are mounted in said bottom.

13. The tool of claim 12, wherein said bottom has an outer side and said tubular element has a front end face which is substantially flush with said outer side, said tubular element being substantially entirely confined within said pot-shaped element.

14. The tool of claim 1, wherein said passages have different dimensions or the numbers of blades in the respective passages are different.

15. The tool of claim 1, wherein said passages have different dimensions and the numbers of blades in the respective passages are different.

16. The tool of claim 1, wherein said holder and said blades constitute an integral, injection molded plastic component.

17. The tool of claim 1, wherein said holder constitutes an integral, injection molded plastic component and said blades are metallic.

* * * * *